US006121874A

United States Patent [19]

O'Donnell

[11] Patent Number: 6,121,874

[45] Date of Patent: Sep. 19, 2000

[54] MULTI-STATION DANGEROUS CONDITION ALARM SYSTEM INCORPORATING ALARM AND CHIRP ORIGINATION FEATURE

[76] Inventor: Thomas J. O'Donnell, 23414 W. Winston, Plainfield, Ill. 60544

[21] Appl. No.: 09/318,698

[22] Filed: May 25, 1999

Related U.S. Application Data

[63] Continuation of application No. 08/902,190, Jul. 29, 1997, Pat. No. 5,933,078.

[51] Int. Cl.[7] ..... G08B 29/00

[52] U.S. Cl. ..... 340/506; 340/512; 340/517

[58] Field of Search ..... 340/506, 512, 340/517, 825.2, 825.14, 825.57, 825.61

[56] References Cited

U.S. PATENT DOCUMENTS

| | | | |
|---|---|---|---|
| 4,622,544 | 11/1986 | Bially et al. | 340/636 |
| 5,154,504 | 10/1992 | Helal et al. | 362/20 |
| 5,726,627 | 3/1998 | Kane et al. | 340/531 |

FOREIGN PATENT DOCUMENTS

| | | |
|---|---|---|
| 0 148 708 | 7/1985 | European Pat. Off. . |
| 2 611 955 | 9/1988 | France . |
| 2 175 424 | 11/1986 | United Kingdom . |

*Primary Examiner*—Daryl Pope

*Attorney, Agent, or Firm*—Terrence Terry Martin; J. J. Morris; Sean D. Detweiler

[57] ABSTRACT

In a dangerous condition sensing alarm system which includes a plurality of interconnected dangerous condition sensing units, such as smoke detectors, of the general type in which each unit responds to an apparently sensed dangerous condition by issuing an audible alarm and also by transmitting, from an input/output terminal, a signal to the other units (received as an external alarm signal at corresponding input/output terminals of the other units) so that an alarm condition sensed by any one of the units results in alarms being sounded by all the units, a unit initiating an alarm (which may be false) is marked by an alarm origination circuit. The alarm origination circuit includes a visual indicator (such as an LED) and a latch device (such as an SCR) connected in-circuit such that, when the SCR is turned "on", the LED is activated and remains lit until the SCR is turned "off". The SCR is turned "on" by a signal developed from the audio frequency drive to the unit annunciator unless this action has been earlier inhibited by an electronic switch which, just before the local alarm is sounded, places a virtual ground on the SCR gate. The electronic switch is activated by an external alarm signal more quickly than the local unit's audio frequency drive is established. Thus, an external alarm signal will not cause the LED to light.

38 Claims, 2 Drawing Sheets

MULTI-STATION DANGEROUS CONDITION ALARM SYSTEM INCORPORATING ALARM AND CHIRP ORIGINATION FEATURE

RELATED APPLICATION

This is a continuation of, and claims priority to, U.S. patent application Ser. No. 08/902,190 filed Jul. 29, 1997, now U.S. Pat. No. 5,933,078, the subject matter of which is incorporated herein by reference.

FIELD OF THE INVENTION

The invention relates to the art of multi-station dangerous condition alarm systems (for example, multi-station smoke detection systems) incorporating an alarm origination feature which identifies at which station an alarm condition was sensed or apparently sensed and which also identifies which station has issued a low battery "chirp".

BACKGROUND OF THE INVENTION

A feature of many modern dangerous condition alarm units—such as smoke detectors, CO detectors, etc.—is that a multi-station system may be established by suitably interconnecting individual units. Thus, for example, a home may employ a plurality of smoke detectors distributed in a corresponding plurality of rooms with the individual smoke detectors interconnected such that an alarm condition sensed at any station results in all the smoke detectors sounding an alarm. This arrangement has the obvious advantage of providing an indication of an alarm condition sensed in another room which may be sufficiently remote from the present location of the inhabitants that the alarm might not otherwise be noticed until the condition which caused the alarm has progressed to a dangerous state. As a specific example, a fire originating in a kitchen at night and causing a smoke detector in the kitchen to sense the resulting presence of smoke will cause an alarm to sound in the bedrooms in which the occupants are asleep, thus awakening the occupants as soon as the alarm condition in the kitchen is sensed.

However, a defective unit may be among those constituting a multi-station dangerous condition alarm system. If a false alarm is initiated and the units are still within a warranty period, the owner may believe it is necessary to return all the units making up the system to the retailer or manufacturer because it cannot be easily determined which unit is defective. This is a costly problem for the manufacturer and also leaves the consumer without a dangerous condition alarm system, at least temporarily.

Similarly, most dangerous condition sensing units are either battery operated or incorporate battery back up if normally energized off the line. Typically, a battery condition monitoring feature is included in which an audible "chirp" is periodically issued if the voltage across the battery terminals has fallen below a predetermined level, thus indicating that the remaining battery life is short and that the battery should be replaced. Because of the character of the "chirp", it is sometimes difficult to determine which of the several units has the failing battery, and the owner may elect to either ignore the warning or change the batteries in all the system units, both unsatisfactory expedients.

It will therefore be appreciated that it would be desirable to provide a feature by which an individual unit in a multi-station dangerous condition alarm system can be identified as the originator of an alarm (which may be false) sounded by all the units or the originator of a low battery warning "chirp" sounded by the unit with a failing battery. In the former case, if the sounded alarm is determined to be false and the result of a defective unit, only that individual unit need be returned to the retailer or manufacturer for replacement, thus saving time and money for the owner, the retailer and/or the manufacturer while leaving in place the remainder of the units in fully operative condition. In the latter case, only the battery in the individual unit which originated the low-battery "chirp" need be replaced, thus saving time and money for the owner of the system.

OBJECTS OF THE INVENTION

It is therefore an object of the invention to provide an improved multi-station dangerous condition alarm system.

It is also an object of the invention to provide such an improved system in which an individual unit in the multi-station system which has triggered a false alarm sounded by all the units may be readily identified.

In another aspect, it is an object of the invention to provide such an improved system in which an individual unit in the multi-station system which is the source of a low battery signal may be readily identified.

SUMMARY OF THE INVENTION

Briefly, these and other objects of the invention are achieved in a dangerous condition sensing alarm system which includes a plurality of interconnected dangerous condition sensing units, such as smoke detectors, of the general type in which each unit responds to an apparently sensed dangerous condition by issuing an audible alarm and also by transmitting, from an input/output terminal, a signal to the other units (received as an external alarm signal at corresponding input/output terminals of the other units) so that an alarm condition sensed by any one of the units results in alarms being sounded by all the units. In order to indicate which unit initiated an alarm, an alarm origination circuit is incorporated into each of the units. Each alarm origination circuit includes a visual indicator (such as an LED) and a latch device (such as an SCR) connected in-circuit such that, when the SCR is turned "on", the LED is activated and remains lit until the SCR is turned "off" to thereby identify the unit which sensed the apparent alarm condition (which may be false). In a preferred embodiment, the SCR is turned "on" by a signal developed from the audio frequency drive to the unit annunciator unless this action has been earlier inhibited. Thus, provision is made to inhibit the SCR from being turned "on" when the alarm condition was sensed by another unit in the system as reflected by an external alarm signal applied to the input/output terminal of the local unit. This is achieved, in the presently preferred embodiment, by controlling the rate of development of the external alarm to the input/output terminal (for example, by charging a capacitor through an isolation resistor) in order to briefly delay the issuance of an audible alarm by the local unit. An electronic switch, such as a transistor, is configured to respond to a lower external alarm signal level than that at which the local alarm will be sounded and thus can be employed to prevent the SCR from being turned "on" by the subsequently sounded local alarm by, for example, forcing the gate of the SCR to a virtual ground.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DESCRIPTION OF THE PREFERRED EMBODIMENTS

Figure 1:
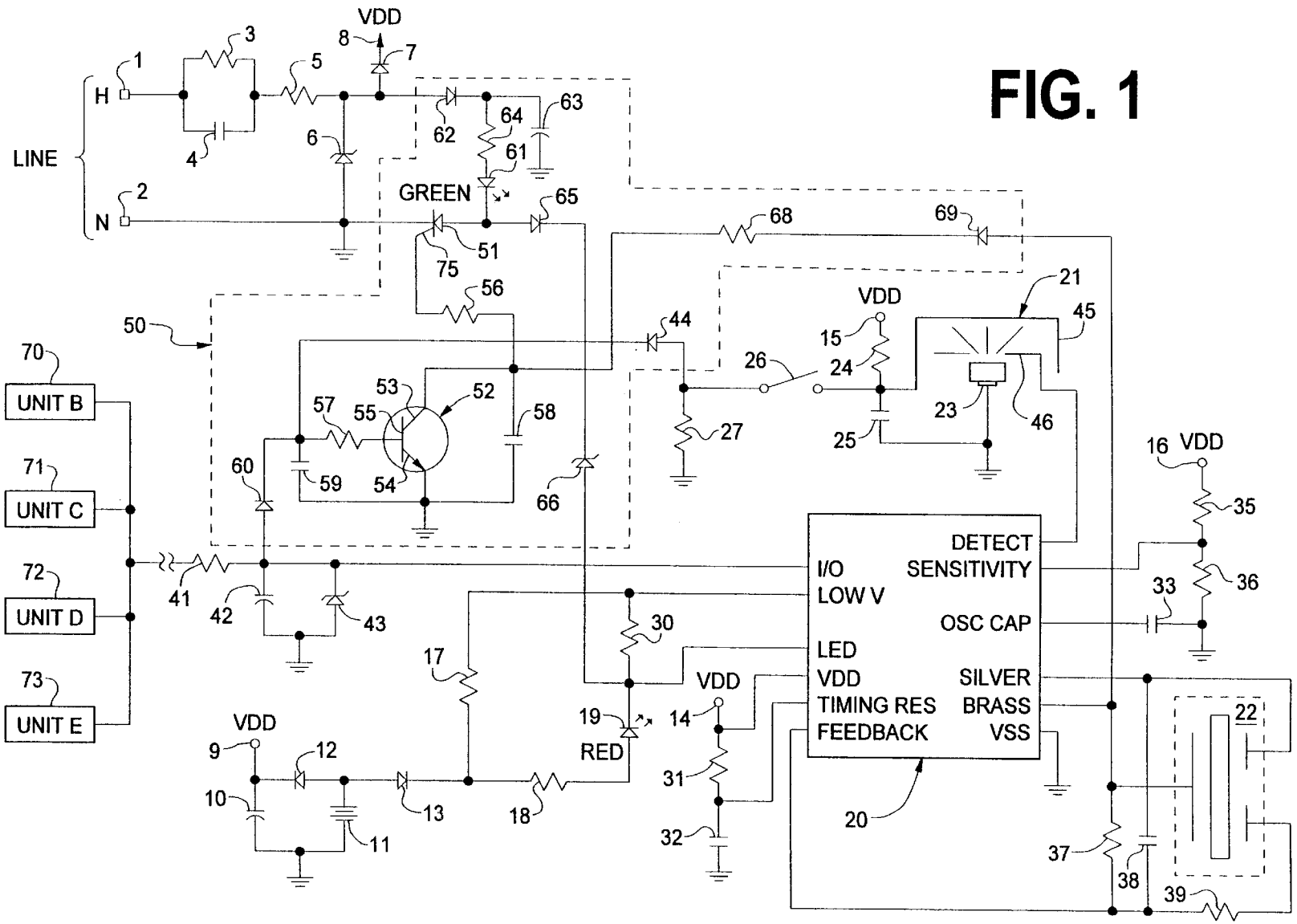
FIG. 1 is a schematic of a first embodiment of a multi-station system incorporating the invention.

Referring now to FIG. 1, there is shown an exemplary environment in which the invention may be advantageously practiced. More particularly, detailed circuitry for a smoke detector unit modified in accordance with the invention is shown. In the example, the smoke detector is one (for convenience, referred to as "Unit A" in the following description) of five identical units, the other four units being designated Unit B 70, Unit C 71, Unit D 72 and Unit E 73. In accordance with conventional practice, these units may be distributed throughout a space, such as one each in several rooms in a home to be monitored, and are interconnected such that an alarm condition sensed by any one of the units results in alarms sounding at all the units. As previously discussed, the purpose of the present invention is to indicate which unit has been the source of the issuance of an alarm or a low battery "chirp" in order to isolate a defective unit in the case of a false alarm and, alternatively, to determine which of the several units requires a battery change.

Consider now the conventional portion of the circuitry of the smoke detector (Unit A) illustrated in detail in FIG. 1, it being understood that all the circuitry shown in FIG. 1 is substantially duplicated in the other units 70, 71, 72, 73. The neutral side 2 of a power line input is connected to reference ground potential. The high side 1 of the line is coupled through a capacitor bleed down resistor 3 which is disposed in parallel with a reactive power supply capacitor 4. The other end of the resistor 3 and capacitor 4 are connected to one end of a current limiting/voltage dropping resistor 5 which has its other end connected to the cathode of a zener diode 6. Zener diode 6 has its anode connected to ground potential. The resistance and power handling values of resistor 5 are selected to permit the zener diode 6 to operate within its normal range. The zener diode 6 is selected to rectify the input from the line and to regulate the electrical point between the resistor 5 and the zener diode to about +10.0 volts. Thus, the cathode of zener diode 6 serves to establish the normal, line derived and voltage regulated power source which is provided to the unit circuitry through blocking diode 7 to an electrical point represented by the arrow 8. The "VDD" designation given at arrow 8 is, during normal operation, a voltage of about 9.75 volts (taking into account the forward voltage drop across diode 7). Thus, energizing power for the entire conventional portion of the circuit is coupled from arrow 8 to electrical points 9, 14, 15 and 16 such that the circuit normally operates from power obtained from the line as well known in the art.

However, in accordance with conventional practice, a back-up battery 11, which has its negative side connected to ground potential, is provided to immediately take over energizing the alarm circuit in the event of a power line failure. During normal operation, the voltage appearing at electrical point 9 is, as previously noted, about 9.75 volts, and capacitor 10 is a filter routinely serving to maintain the voltage at a steady level. Thus, during normal operation, no current is drawn from the battery 11 through the diode 12 because its actual normal voltage output is slightly less than 9.75 volts, and the diode 12, having its cathode connected to electrical point 9 and its anode connected to the positive side of the battery, is therefore back biased. (However, during normal operation, as will be explained below, the battery is periodically checked to induce current flow from the battery through a test circuit.) If there should be a line failure such that the voltage at the cathode of zener diode 6 drops to zero or a low value, the battery 11 will provide power to all the conventional circuitry through diode 12 which will then be forward biased. Accordingly, the electrical points 14, 15 and 16 will remain within a proper voltage range for maintaining ongoing operation of the circuit. When the line is restored, the circuitry will again be energized from electrical point 8, and electrical point 9 will rise above the nominal voltage of battery 11 to again back bias diode 12 and thus relieve the battery 11 of the conventional circuit load. For convenience, whether operating from the line or the battery 11, the operating level voltage level is hereinafter designated "VDD".

The routine operation of the circuitry shown in FIG. 1 is carried out by cooperation among a conventional smoke detector integrated circuit 20, an ion chamber detector 21 and an annunciator 22 and their support components. Power for operating the integrated circuit 20 is obtained by applying VDD to its "VDD" input and connecting its "VSS" input to ground. Timing functions for the integrated circuit 20 are governed by the values of a timing resistor 31 and an oscillator capacitor 33. One end of resistor 31 is connected to the "VDD" input of the integrated circuit 20, and its other end is connected to the "timing resistor" input and also to one side of a stabilizing capacitor 32 which has its other side connected to ground. The oscillator capacitor 33 is connected between the "oscillator capacitor" input to integrated circuit 20 and ground.

The housing 45 of ionization chamber 21 is biased to VDD through isolation resistor 24. Capacitor 25, connected between the chamber housing 45 and ground potential, serves to stabilize this bias potential against noise spikes. Ion source 23 (which may be, e.g., a commercially available Americium 241) is also grounded, and center electrode probe 46 is connected to the "detect" input of integrated circuit 20. The sensitivity of the detector circuit included in the integrated circuit 20 is established by a voltage obtained at the junction between resistors 35 and 36 which are serially connected between VDD and ground and applied to the "sensitivity" input of the integrated circuit.

The annunciator 22 serves to sound alarms when an unsafe condition is sensed by the detector 21 in conjunction with the "sensitivity" input and also to issue periodic audible "chirps" when a low battery condition is detected. Annunciator 22 may suitably be a piezoelectric transducer which is driven by "silver" and "brass" outputs of the integrated circuit 20. The character of the alarm sound issued by annunciator 22 is partly determined by the value of capacitor 38 which is connected between the "silver" output of integrated circuit 20 and ground potential and also by the resistor 37 which is connected between the "brass" output and ground. (The values of the timing components also affect the character of the sounds issued by the annunciator 22.) Feedback is delivered to the "feedback" input of integrated circuit 20 from a sense electrode of the annunciator 22 through resistor 39, to insure that the annunciator oscillates with maximum audibility when an alarm or a "chirp" is to be issued.

A push-to-test switch 26 is connected between one end of a resistor 27, which has its other end connected to ground potential, and the junction between resistor 24, capacitor 25 and the housing 45 of the ion chamber sensor 21. When the push-to-test switch 26 is actuated, the voltage biasing the housing 45 is sufficiently lowered as to correspondingly lower the voltage seen at the "detect" input of the integrated circuit 20 and thus trigger a simulated alarm condition, the issuance of which reassures the owner that the unit is operative.

An input/output ("I/O") terminal of the integrated circuit 20 is connected, via isolation resistor 41, to the corresponding "I/O" terminals of each of Unit B 70, Unit C 71, Unit D 72 and Unit E 73 via corresponding isolation resistors in each of the other units. In addition, a zener diode 43 is connected between the "I/O" terminal and ground potential and in parallel with a filter capacitor 42. The zener diode 43 serves to protect the I/O common line against externally originating transients. The filter capacitor 42 also protects the integrated circuit 20 from damage due to externally originating transients.

In operation, if sufficiently concentrated smoke is present in the ionization chamber 21 to lower the voltage on the probe 46 enough to indicate an alarm condition, the integrated circuit 20 responds by issuing appropriate drive signals to the annunciator 22, typically to produce unmistakable raucous, repetitive honks. This condition is locked in by the integrated circuit 20 such that the honking will continue until the alarm condition is no longer present. In addition, a positive voltage signal is issued on the "I/O" terminal of the integrated circuit 20 and is communicated to Unit B 70, Unit C 71, Unit D 72 and Unit E 73 via resistor 41 such that the annunciators of those units are also caused to sound the alarm until the alarm condition is no longer present.

Those skilled in the art will recognize that the system shown in FIG. 1 as described so far is conventional and representative of various systems in which the invention finds use. Other examples which could have been used are systems made up of interconnected CO detectors or hybrid systems incorporating both CO detectors and smoke detectors, heat detectors and/or other dangerous condition detectors.

The exemplary embodiment of the invention chosen for illustration is the indicator circuit enclosed within the dashed lines indicated at 50 in FIG. 1. Power for the indicator circuit 50 is obtained from the cathode of zener diode 6 through diode 62 to one end of dropping resistor 64 with the voltage at the junction of diode 62 and resistor 64 stabilized by filter capacitor 63. Thus, it will be noted that, preferably, the battery 11 does not pick up the load of the indicator circuit 50 in the event of a line power failure (because the current draw can be considerable which would greatly reduce battery life); correspondingly, the indicator circuit 50 is operative only when line power is present.

The other end of dropping resistor 64 is connected to the anode of green LED 61 which has its cathode connected to a junction between respective anodes of silicon controlled rectifier (SCR) 51 and blocking diode 65. The cathode of SCR 51 is connected to ground while the cathode of diode 65 is connected to the cathode of a zener diode 66 which has its anode connected to the "LED" output of integrated circuit 20.

The gate 75 of the SCR 51 is connected, through isolation resistor 56, to the collector 53 of an NPN transistor 52 which has its emitter 54 connected to ground. The base 55 of transistor 52 is coupled to the cathode of a diode 60 through isolation resistor 57, and the anode of diode 60 is connected to the "I/O" terminal of the integrated circuit 20. The junction of resistor 57 and diode 60 is also connected to the cathode of diode 44 which has its anode connected to the junction between the switch 26 and resistor 27. The voltages at the junction between the resistor 57 and the diode 60 and the voltage at the collector 53 of the transistor 52 are conventionally stabilized against electrical noise by capacitors 59 and 58, respectively. Diode 69 and resistor 68 are series connected between the "brass" output of the integrated circuit 20 and the collector 53 of the transistor 52. The diode 69 is oriented with its anode being connected to the "brass" output.

The indicator circuit 50 takes advantage of certain inherent characteristics of silicon controlled rectifiers such as the SCR 51. When a positive voltage is applied to the anode and there is no current flowing into the gate of the device, there is no current flow from the anode to the cathode; the device is "off". When a positive voltage is applied to the cathode, the SCR simply looks like a reverse-biased rectifier. However, when a positive voltage is applied to the anode and a current is passed between the gate and the cathode, the SCR latches "on", conducting load current from the anode to the cathode, and remains latched "on" as long as the anode current remains above a value called the holding current. That is, removing the gate signal which turned the SCR "on" does not turn it "off". To turn an SCR "off" after it has latched "on", the positive voltage is removed from the anode for a sufficient period (typically viewed as instantaneous in the present application) as to permit charges on certain internal structure to settle. Sometimes, a negative voltage is applied briefly to the anode to insure turnoff.

Referring again to FIG. 1, during normal operation, the junction of the cathode of the green LED 61, the anode of the SCR 51 and the anode of the diode 65 is held high through the series connected resistor 64 and green LED 61. (The zener diode 66 and diode 65 do not substantively enter into the determination of the voltage at the anode of the SCR 51 because the "LED" output exhibits a high impedance during normal operation except very briefly when periodically testing the battery.) However, the SCR 51 is "off" during normal operation because its gate 75 is biased to ground via resistor 37, diode 69, resistor 68 and resistor 56. As a result, no substantial current flows through the green LED 61 which is therefore not illuminated.

If an alarm condition (even if false) is sensed by the sensor 45 and the annunciator 22 is correspondingly driven by the "silver" and "brass" outputs from the integrated circuit 20, the audio frequency electrical signal (taken from the "brass" output in the example) is rectified by the diode 69, and the resulting positive voltage is applied to the gate 75 of the SCR 51 via resistors 68 and 56. As a result, the SCR is turned "on" to place a near ground potential on the cathode of the green LED 61 which therefore conducts so as to turn "on"; i.e., the green LED is illuminated and alarm origination has taken place.

At the same time, as previously described, the "I/O" output of the integrated circuit 20 issues a signal which is sent to Unit B 70, Unit C 71, Unit D 72 and Unit E 73 via resistor 41 in order that the alarm will also sound at each of those units. In the example, the voltage level of this alarm interconnect signal is in excess of VDD/3 (and typically, slightly less than VDD) because that is the design minimum trigger level for instituting the alarm at the other units.

The green LED 61 will now remain illuminated, because the SCR 51 is latched "on", even after the alarm condition has passed and the annunciator 22 no longer sounds. If the alarm has been false, indicating a defective unit, examination of the green LEDs of all the units will reveal that, in the example, it is Unit A which caused the false alarm, and this unit may therefore be removed from the system (for replacement by the retailer or manufacturer) without the need to return all the units. Whether the alarm has been false or genuine, it is necessary to remove line power to turn "off" the SCR 51, and hence the green LED 61, once it has been turned "on".

Consider now a similar event in which it is Unit C 71 that has sensed an alarm condition (which may be false) and has accordingly issued a signal on the I/O line to Unit A (shown in detail), Unit B 70, Unit D 72 and Unit E 73 which respond by sounding the alarm. However, because of the filtering action of the resistor 41 (560 ohms in the example) and capacitor 42 (33 microfarads in the example), the voltage level (VDD/3 in the example) which will trigger the "I/0" action to turn on the local annunciator 22 does not take place immediately, but requires a few milliseconds, and this characteristic is used to advantage to prevent the local LED 61 from latching "on" by the action of the SCR 51 when the alarm condition has been sensed by another unit.

As a result of the issuance of an alarm sensed signal from Unit C 71, capacitor 42 charges through resistor 41 until a level is reached, substantially lower than the trigger level for starting the local audible alarm, which will turn on the NPN transistor 52. That is, the increasing voltage present across the capacitor 42 is communicated to the base 55 of the NPN transistor 52 and turns it on when the level at the base reaches about 0.6 volts in the example. This results in a near ground voltage being placed on the collector 53 of the transistor 52. The voltage level across the capacitor 42 will continue to increase until the integrated circuit 20 tuns on the local annunciator 22 slightly later than the transistor 53 was turned on. As a result, the positive voltage developed by the diode 69 will be full dropped across the resistor 68 such that the gate 75 of the SCR 51 will remain virtually grounded, thereby preventing the SCR from latching on and illuminating the green LED 61. Therefore, the green LED 61 remains dark and there is correctly no indication that Unit A caused the alarm (which might be false). The same action will take place in Unit B 70, Unit D 72 and Unite E 73 whereas the green LED at Unit C 71 will be latched "on" as previously described to identify the source unit of the alarm.

As previously mentioned, push-to-test switch 26 may be actuated to simulate an alarm condition and thus insure that the local unit is operating. When the switch 26 is thus actuated, a positive voltage appearing at the junction of resistor 27 (which has its other end connected to ground) and (through the temporarily closed switch) resistor 24 (which has its other end connected to VDD) is coupled through diode 44 and resistor 57 to the gate 55 of NPN transistor 51, thus turning on the transistor to ground its collector 53 which, as previously described, holds the gate 75 of the SCR 51 at ground potential which prevents the SCR from turning "on". Therefore, the test function will not cause the green LED 61 to light.

The condition of the battery 11 is continuously monitored from the positive terminal of the battery through diode 13 and resistor 17 to the "low V" input to the integrated circuit 20. The cathode of diode 13 is also connected to one end of a voltage dropping resistor 18 which is connected in series with red light emitting diode 19 which is also connected to the "LED output" of integrated circuit 20. Resistor 30, connected between the LED and "low V" inputs to integrated circuit 20, serves to establish, in cooperation with the resistor 17, the voltage value at the "low V" input which will be interpreted as indicating a failing battery.

The integrated circuit 20 periodically (for example, once a minute) tests the battery by briefly switching the "LED" output from a high impedance to ground potential. This causes the red LED 19 to momentarily (e.g., 10 milliseconds) illuminate and correspondingly load the battery and also causes the green LED 61 to momentarily illuminate, at reduced level, to indicate that line power is on. At this time, the voltage at the "low V" input of the integrated circuit 20 is monitored and, if it falls below the predetermined level, a "chirp" is issued by the annunciator 22 to provide an audible indication of the failing battery.

During this "chirp", the brass voltage signal is rectified through diode 69 and resistor 68 to capacitor 58, and the resulting voltage level is applied to the gate 75 of the SCR 51 to turn on SCR 51, thus creating a current path through the green LED leaving it illuminated. Therefore, under these conditions, the green LED 61 will remain illuminated, thus providing a visual indication of which unit has a failing battery. When the battery has been replaced, the unit will stop chirping.

In the preferred embodiment, access to the battery compartment cannot be made without uncoupling a plug (not shown) to the line. Thus, momentarily removing line power in this manner serves to turn "off" the SCR 51 as previously described and thus extinguish the LED 61 in conjunction with the battery renewal. Alternatively, a pushbutton or other expedient may be used to turn "off" the SCR 51 by briefly interrupting the line source.

Figure 2:
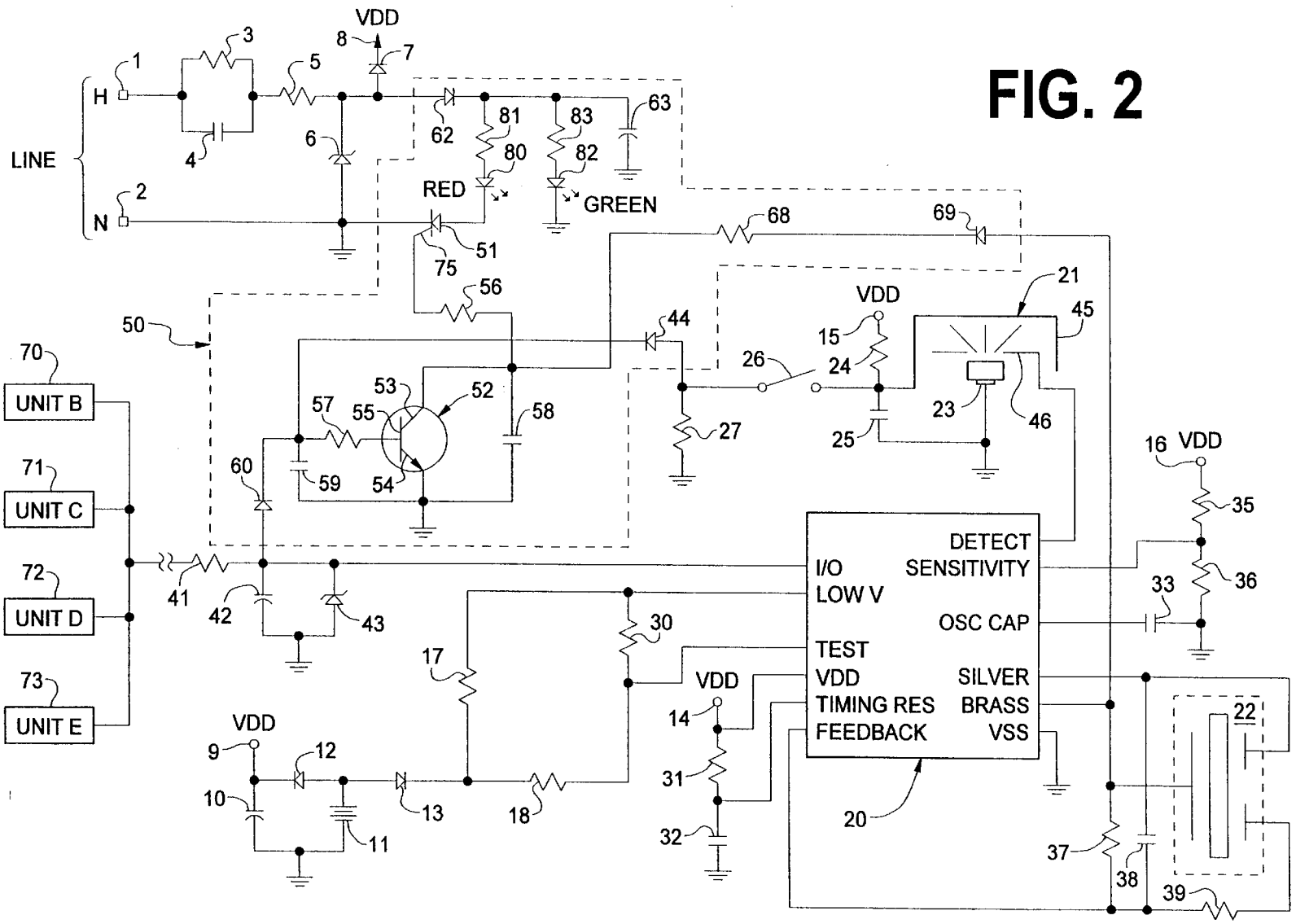
FIG. 2 is a schematic of a second embodiment of a multi-station system incorporating the invention.

FIG. 2 illustrates a variant embodiment in which a green LED 82 is employed to indicate that line power is present and a red LED 80 indicates that the local unit is the source of an alarm or a chip signaling a low battery. Green LED 82 is connected in series with dropping resistor 83 between the cathode of diode 62 and ground and therefore will remain continuously illuminated as long as line power is present.

The red LED 80 is connected in series with dropping resistor 81 between the cathode of diode 62 and the anode of SCR 51. As the green LED 82 provides ongoing confirmation of the presence of line power, there is no need to periodically flash the red LED 51 at a reduced level such that the diode 65 and zener diode 66 included in the FIG. 1 embodiment can be eliminated. In addition, the condition of the battery 11 in the FIG. 2 embodiment is tested by placing a momentary near ground from the "test" output (merely redesiginated in the example) of integrated circuit 20. Inasmuch as a low battery condition will result in latching "on" the red LED 80, the battery test LED (19 in FIG. 1) can be eliminated. The values of the resistors 17, 18 and 30 are adjusted as appropriate to account for the elimination of the battery test LED.

Those skilled in the art will appreciate that while, for purposes of clarity, the indicator circuit 50 has been shown as implemented using discrete components, the indicator circuit can be readily integrated with the other circuitry in the integrated circuit 20 to simplify fabrication and secure miniaturization.

Thus, while the principles of the invention have now been made clear in illustrative embodiments, there will be immediately obvious to the those skilled in the art many modifications of structure and components used in the practice of the invention which are particularly adapted for specific environments and operating requirements without departing from those principles.

What is claimed is:

1. In a dangerous condition sensing alarm system including a plurality of interconnected dangerous condition sensing units in which each unit includes means for sensing a dangerous condition and issuing an audible alarm from an annunciator in response thereto and for transmitting, from an input/output terminal, a signal to the other units, received at corresponding input/output terminals of such other units, in order than an alarm sensed by any one of the units results in alarms being issued by all the units, the improvement in which an alarm origination circuit is incorporated into each of the units to provide an indication as to which unit apparently sensed a dangerous condition which caused all the units to sound an alarm, each alarm origination circuit in a local unit comprising:

A) an alarm origination indicator;

B) a latch connected in-circuit with said alarm origination indicator such that, when said latch is turned "on", said alarm origination indicator is activated and remains activated until said latch is turned "off";

C) latch actuation means responsive to the issuance of an alarm by the local unit by developing a local alarm signal which will cause said latch to be turned "on" unless such action has been inhibited, said local alarm signal being developed from an audio drive signal applied to the annunciator;

D) signal level delay means connected between the input/output terminal and an electrical point common to all the interconnected units, said signal level delay means being adapted to delay an external alarm signal received from an input/output terminal of another unit from instituting the issuance of an alarm by the local unit; and E) latch inhibit means coupled to said signal level delay means and adapted to sense the presence of an external alarm signal before an alarm is issued by the local unit in response to the external alarm signal, said latch inhibit means being responsive to sensing an external alarm signal by inhibiting said latch from being turned "on" due to the subsequent issuance of an alarm by the local unit.

2. The alarm origination circuit of claim 1 in which said latch comprises a silicon controlled rectifier having a gate and in which said local alarm signal is coupled to said gate.

3. The alarm origination circuit of claim 2 in which said signal level delay means comprises a resistor connected between the input/output terminal and the electrical point common to all the interconnected units and a capacitor connected between the input/output terminal and a reference potential such that an external alarm signal charges said capacitor through said resistor and said latch inhibit means is activated before an alarm is issued by the local unit.

4. The alarm origination circuit of claim 3 in which said latch inhibit means includes an electronic switch responsive to an external alarm signal to apply a virtual ground to said gate to thereby inhibit said silicon controlled rectifier from being turned "on".

5. The alarm origination circuit of claim 1 in which said alarm origination indicator is a light emitting diode connected intermediate a voltage source and said silicon controlled rectifier such that, when said silicon controlled rectifier is latch "on", current flows through said light emitting diode which is therefore illuminated to indicate that the local unit apparently sensed a dangerous condition and initiated a system alarm.

6. The alarm origination circuit of claim 2 in which said alarm origination indicator is a light emitting diode connected intermediate a voltage source and said silicon controlled rectifier such that, when said silicon controlled rectifier is latched "on", current flows through said light emitting diode which is therefore illuminated to indicate that the local unit apparently sensed a dangerous condition and initiated a system alarm.

7. The alarm origination circuit of claim 3 in which said alarm origination indicator is a light emitting diode connected intermediate a voltage source and said silicon controlled rectifier such that, when said silicon controlled rectifier is latched "on", current flows through said light emitting diode which is therefore illuminated to indicate that the local unit apparently sensed a dangerous condition and initiated a system alarm.

8. The alarm origination circuit of claim 4 in which said alarm origination indicator is a light emitting diode connected intermediate a voltage source and said silicon controlled rectifier such that, when said silicon controlled rectifier is latched "on", current flows through said light emitting diode which is therefore illuminated to indicate that the local unit apparently sensed a dangerous condition and initiated a system alarm.

9. The alarm origination circuit of claim 2 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

10. The alarm origination circuit of claim 3 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

11. The alarm origination circuit of claim 4 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

12. The alarm origination circuit of claim 5 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

13. The alarm origination Circuit of claim 7 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

14. The alarm origination circuit of claim 8 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

15. The alarm origination circuit of claim 1 in which said signal level delay means comprises a resistor connected between the input/output terminal and the electrical point common to all the interconnected units and a capacitor connected between the input/output terminal and a reference potential such that an external alarm signal charges said capacitor through said resistor and said latch inhibit means is activated before and alarm is issued by the local unit.

16. In a dangerous condition sensing alarm system including a plurality of interconnected dangerous condition sensing units in which each unit includes means for sensing a dangerous condition and issuing in response thereto and for transmitting, from an input/output terminal, a signal to the other units, received at corresponding input/output terminals of such other units, in order than an alarm sensed by any one of the units results in alarms being issued by all the units, the improvement in which an alarm origination circuit is incorporated into each of the units to provide an indication as to which unit apparently sensed a dangerous condition which caused all the units to sound an alarm, each alarm origination circuit in a local unit comprising:

B) an alarm origination indicator;

B) a latch connected in-circuit with said alarm origination indicator such that, when said latch is turned "on", said alarm origination indicator is activated and remains activated until said latch is turned "off";

C) latch actuation means responsive to the issuance of an alarm by the local unit by developing a local alarm signal which will cause said latch to be turned "on" unless such action has been inhibited;

D) signal level delay means connected between the input/output terminal and an electrical point common to all the interconnected units, said signal level delay means being adapted to delay an external alarm signal received from an input/output terminal of another unit from instituting the issuance of an alarm by the local unit, said signal level delay means comprising a resistor connected between the input/output terminal and the electrical point common to all the interconnected units and a capacitor connected between the input/output terminal and a reference potential such that an external alarm signal charges said capacitor through said resistor and said latch inhibit means is activated before an alarm is issued by the local unit; and E) latch inhibit means coupled to said signal level delay means and adapted to sense the presence of an external alarm signal before an alarm is issued by the local unit in response to the external alarm signal, said latch inhibit means being responsive to sensing an external alarm signal by inhibiting said latch from being turned "on" due to the subsequent issuance of an alarm by the local unit.

17. The alarm origination circuit of claim 16 in which said latch comprises a silicon controlled rectifier having a gate and in which said local alarm signal is coupled to said gate.

18. The alarm origination circuit of claim 17 in which said signal level delay means comprises a resistor connected between the input/output terminal and the electrical point common to all the interconnected units and a capacitor connected between the input/output terminal and a reference potential such that an external alarm signal charges said capacitor through said resistor and said latch inhibit means is activated before an alarm is issued by the local unit.

19. The alarm origination circuit of claim 18 in which said latch inhibit means includes an electronic switch responsive to an external alarm signal to apply a virtual ground to said gate to thereby inhibit said silicon controlled rectifier from being turned "on".

20. The alarm origination circuit of claim 16 in which said alarm origination indicator is a light emitting diode connected intermediate a voltage source and said silicon controlled rectifier such that, when said silicon controlled rectifier is latch "on", current flows through said light emitting diode which is therefore illuminated to indicate that the local unit apparently sensed a dangerous condition and initiated a system alarm.

21. The alarm origination circuit of claim 17 in which said alarm origination indicator is a light emitting diode connected intermediate a voltage source and said silicon controlled rectifier such that, when said silicon controlled rectifier is latched "on", current flows through said light emitting diode which is therefore illuminated to indicate that the local unit apparently sensed a dangerous condition and initiated a system alarm.

22. The alarm origination circuit of claim 18 in which said alarm origination indicator is a light emitting diode connected intermediate a voltage source and said silicon controlled rectifier such that, when said silicon controlled rectifier is latched "on", current flows through said light emitting diode which is therefore illuminated to indicate that the local unit apparently sensed a dangerous condition and initiated a system alarm.

23. The alarm origination circuit of claim 19 in which said alarm origination indicator is a light emitting diode connected intermediate a voltage source and said silicon controlled rectifier such that, when said silicon controlled rectifier is latched "on", current flows through said light emitting diode which is therefore illuminated to indicate that the local unit apparently sensed a dangerous condition and initiated a system alarm.

24. The alarm origination circuit of claim 17 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

25. The alarm origination circuit of claim 18 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

26. The alarm origination circuit of claim 19 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

27. The alarm origination circuit of claim 20 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

28. The alarm origination Circuit of claim 22 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

29. The alarm origination circuit of claim 23 which further includes low battery identification means for indicating if a battery in the local unit is sufficiently drained as to be unreliable for energizing the unit, said low battery identification means including test means for periodically momentarily loading the battery and driving said annunciator to issue a characteristic audible signal each time said battery tests below a predetermined acceptable level of drain such that said characteristic audible signal alternatively develops said local alarm signal and turns said latch "on", thereby indicating that the local unit is the source of the characteristic audible signal and accordingly has a battery which should be replaced.

30. The alarm origination circuit of claim 16 in which the alarm issued by the local unit is an audible alarm issued by an annunciator and in which said local alarm signal is developed from an audio drive signal applied to said annunciator.

31. A sensing alarm device, for providing an alarm indication of a detected dangerous condition within an installed space and, alternately, for providing an alarm indication for a dangerous condition detected by an external sensing alarm device in communication therewith, comprising:

a condition sensor, for sensing a dangerous condition within the installed space and for providing a sensor output signal in response thereto;

a detector circuit, for providing a self detected alarm condition signal in response to the presence of a sensor output signal;

input/output (I/O) circuitry, for presenting said self detected alarm condition signal to, and for receiving an externally detected alarm condition signal from, an external sensing alarm device in communication therewith;

an annunciator, for issuing the alarm indication in response to the presence alone of said self detected alarm condition signal and, alternately, in the presence alone of said externally detected alarm condition signal and, alternately, in the presence of said self detected alarm condition signal jointly with said externally detected alarm condition signal; and an alarm origination indicator circuit, including an indicator device, and responsive to said detector circuit, for actuating said indicator device in the presence of said self detected alarm condition signal to identify the sensing alarm device as the originating alarm source.

32. The device of claim 31 further comprising:

a test switch cooperating with the condition sensor for selectively actuating the condition sensor such that the sensor output signal is generated; and a circuit, cooperating with the test switch, for inhibiting actuation of the alarm origination indicator circuit.

33. The device of claim 31 further comprising:

a battery;

a battery monitoring circuit for generating a signal indicative of a failing battery condition; and wherein the detector circuit, in response to the signal indicative of a failing battery condition, further provides a battery alarm signal to the annunciator and to the alarm origination circuit, causing the annunciator to issue a distinctive alarm associated with a low battery condition, and causing the alarm origination circuit to actuate the indicator device.

34. The device of claim 33 further comprising:

a test switch cooperating with the condition sensor for selectively actuating the condition sensor such that the sensor output signal is generated; and a circuit, cooperating with the test switch, for inhibiting actuation of the alarm origination indicator circuit.

35. The device of claim 31 wherein the alarm origination indicator circuit further comprises a latching device operable, alternately, in a latched on state to actuate said indicator device and in an unlatched state to de-actuate said indicator device said latching device being latched on by said alarm origination indicator circuit in response to the presence of a self detected alarm condition signal and, alternately, to the presence of said battery alarm signal.

36. A dangerous condition sensing alarm device, adapted to be used in a system comprising an interconnected plurality of such dangerous condition sensing devices, and to receive I/O signals from other devices in the system indicative of the other device having sensed an apparent dangerous condition, the device comprising:

a condition sensor for sensing indicia of the dangerous condition, and in response thereto, generating a sensor output signal;

a detector circuit, receptive of the sensor output signal, and, when connected in the system, I/O signals from other devices, for selectively generating;

in response to an I/O signal from another device in the system, subsequent to receiving the I/O signal, a first detector circuit output signal; and in response to the sensor output signal, the first detector circuit output signal and a second detector circuit output signal, the second detector circuit output signal being transmitted as the I/O signal to the detector circuits of the other devices in the system such that a dangerous condition sensed by any one of the devices in the system results in alarms being issued by all of the devices;

an annunciator, responsive to the first detector circuit output signal, for issuing an alarm; and, an indicator circuit, including an indicator device and having the first detector circuit output signal and I/O signals from other devices applied thereto, for, once actuated, generating a predetermined indication of an alarm having been originated by that particular device, the indicator circuit being actuated in response to application of the first detector circuit output signal prior to application of an I/O signal from another device.

37. The apparatus of claim 31 wherein the condition sensor comprises an ion chamber detector, and said indicia of a dangerous condition comprises smoke.

38. The device of claim 35 wherein:

the indicator device comprises an LED of predetermined color; and the latching device comprises a Silicon Controlled Rectifier with anode and cathode disposed to selectively provide a current path through the LED, and a gate responsive to said self detected alarm condition signal and, alternately, to said battery alarm signal.

* * * * *